United States Patent [19]

Mir

[11] 4,052,297

[45] Oct. 4, 1977

[54] MATERIALS HANDLING APPARATUS FOR A FERROFLUID SINK/FLOAT SEPARATOR

[75] Inventor: Leon Mir, Brookline, Mass.

[73] Assignee: Avco Corporation, Wilmington, Mass.

[21] Appl. No.: 365,066

[22] Filed: May 30, 1973

[51] Int. Cl.[2] ..... B03B 13/04

[52] U.S. Cl. ..... 209/1; 209/172.5

[58] Field of Search ..... 209/1, 172.5, 223 R, 209/228, 232, 214, 39, 208, 209; 310/10, 11

[56] References Cited

U.S. PATENT DOCUMENTS

| | | | |
|---|---|---|---|
| 2,209,618 | 7/1940 | Vogel | 209/172.5 X |
| 2,902,153 | 9/1959 | Green | 209/208 |
| 3,460,672 | 8/1969 | Imris | 209/1 |
| 3,483,968 | 12/1969 | Kaiser | 209/1 |
| 3,483,969 | 12/1969 | Rosenweig | 209/1 |
| 3,488,531 | 1/1970 | Rosenweig | 310/10 |
| 3,788,465 | 1/1974 | Reimers et al. | 209/1 |

OTHER PUBLICATIONS

Rosenweig, R. E., "Magnetic Fluids", International Science and Technology, pp. 48–54 & 56, July 1966.

*Primary Examiner*—Frank W. Lutter
*Assistant Examiner*—Ralph J. Hill
*Attorney, Agent, or Firm*—Abraham Ogman

[57] ABSTRACT

This invention is directed to a scheme for increasing the height of a ferrofluid column in a ferrofluid sink/float separator by judiciously locating the access openings into the column of ferrofluid so that said opening is on a predetermined air-ferrofluid interface to support a specific height of a ferrofluid column.

7 Claims, 3 Drawing Figures

MATERIALS HANDLING APPARATUS FOR A FERROFLUID SINK/FLOAT SEPARATOR

Sink/float ferrofluid separation is fully described in U.S. Pat. Nos. 3,483,968, 3,483,969 and 3,488,531, all of which are incorporated by reference.

As noted in the reference patents, a sink/float ferrofluid separator includes a column of ferrofluid that is suspended in a magnetic field. Preferably, the ferrofluid encompasses at least a volume in the magnetic field where the gradient of the magnetic field intensity is constant.

The requirement of filling the constant gradient volume is not necessarily compatible with the design of the magnet to provide the constant gradient volume. As a practical matter, what often happens is that the magnetic field cannot support an adequate height of ferrofluid within the constant gradient volume, in the absence of constraints such as the walls of a container. Though the magnetic field will support enough ferrofluid to fill to constant gradient volume, a portion of this ferrofluid, if not constrained, generally falls below the constant gradient volume. The reason for this will become apparent.

It is possible to place a container within the air gap and within the magnetic field. The container may be filled with enough ferrofluid to fill the constant gradient volume. The foregoing may be easily accomplished so long as the container is closed on all sides except possibly the top. The moment an aperture or opening is defined within the container walls, particularly at the bottom of the container, a portion of the ferrofluid will run out and seek its unconstrained level below the constant gradient volume.

It is therefore an object of the invention to provide an apparatus which avoids the limitations and disadvantages listed above;

It is yet another object of the invention to provide an apparatus which enables one to maintain the height of an unconstrained column of ferrofluid so that it spans the entire constant gradient volume of a magnetic field;

It is yet another object of the invention to provide an apparatus which enables one to adjust the height of a column of ferrofluid contained in the apparatus above the normal unconstrained height;

It is still another object of the invention to provide an apparatus that has access openings into and out of a ferrofluid column while maintaining the height of the ferrofluid above its normal unconstrained height;

It is still another object of the invention to provide teaching whereby the height of a ferrofluid column may be adjusted by the judicious location of openings into and out of the ferrofluid column;

It is still another object of the invention to provide an apparatus with the capability of developing an increased height of ferrofluid for a given cross-sectional area of the ferrofluid column, thus enabling the apparatus to process large pieces of feed stock; and It is still another object of the invention to provide an apparatus which overcomes the inherent incompatibility of defining an economical magnet while maintaining an adequate ferrofluid column height.

The novel features that are considered characteristic of the invention are set forth in the appended claims; the invention itself, however, both as to its organization and method of operation, together with additional objects and advantages thereof, will best be understood from the following description of a specific embodiment when read in conjunction with the accompanying drawings, in which:

Figure 1:
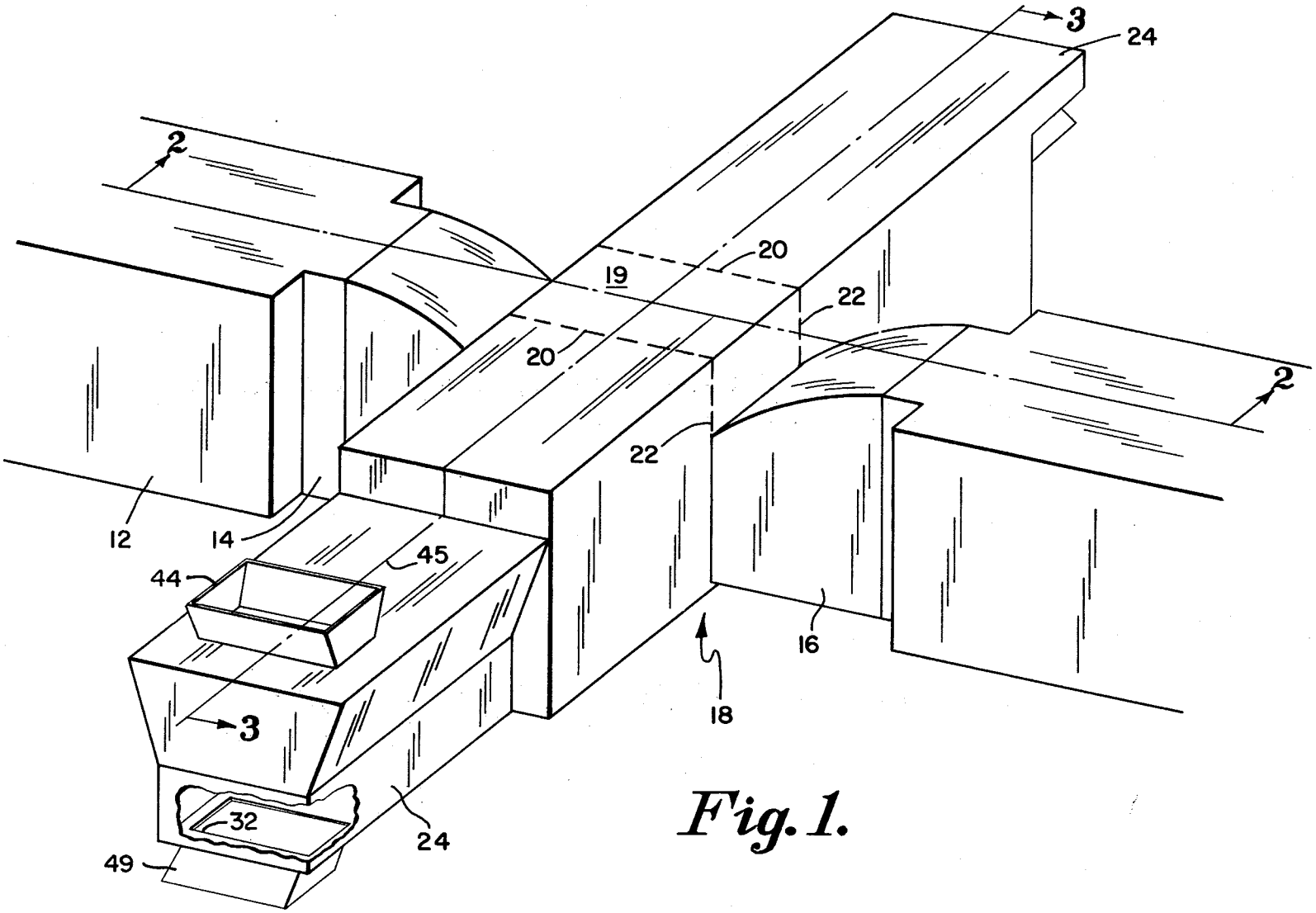
FIG. 1 is a diagrammatic sketch of a sink/float ferrofluid apparatus which embodies the principles of the present invention.

Referring to FIG. 1 of the drawings, there is shown a portion of a magnet 12 containing a pair of pole pieces 14 and 16 defining an air gap 18.

Within the air gap there is included a volume 19 bounded by the dotted lines 20 and 22 in which the gradient of the magnetic field intensity, H, is constant.

Positioned within the air gap is a material handling apparatus 24 which is aligned generally laterally and specifically in this case, perpendicular to the magnetic field which flows between the pole pieces 14 and 16. The materials handling apparatus 24 is made from a non-magnetic material, such as aluminum, and its salient features are more fully disclosed in FIG. 3.

Figure 2:
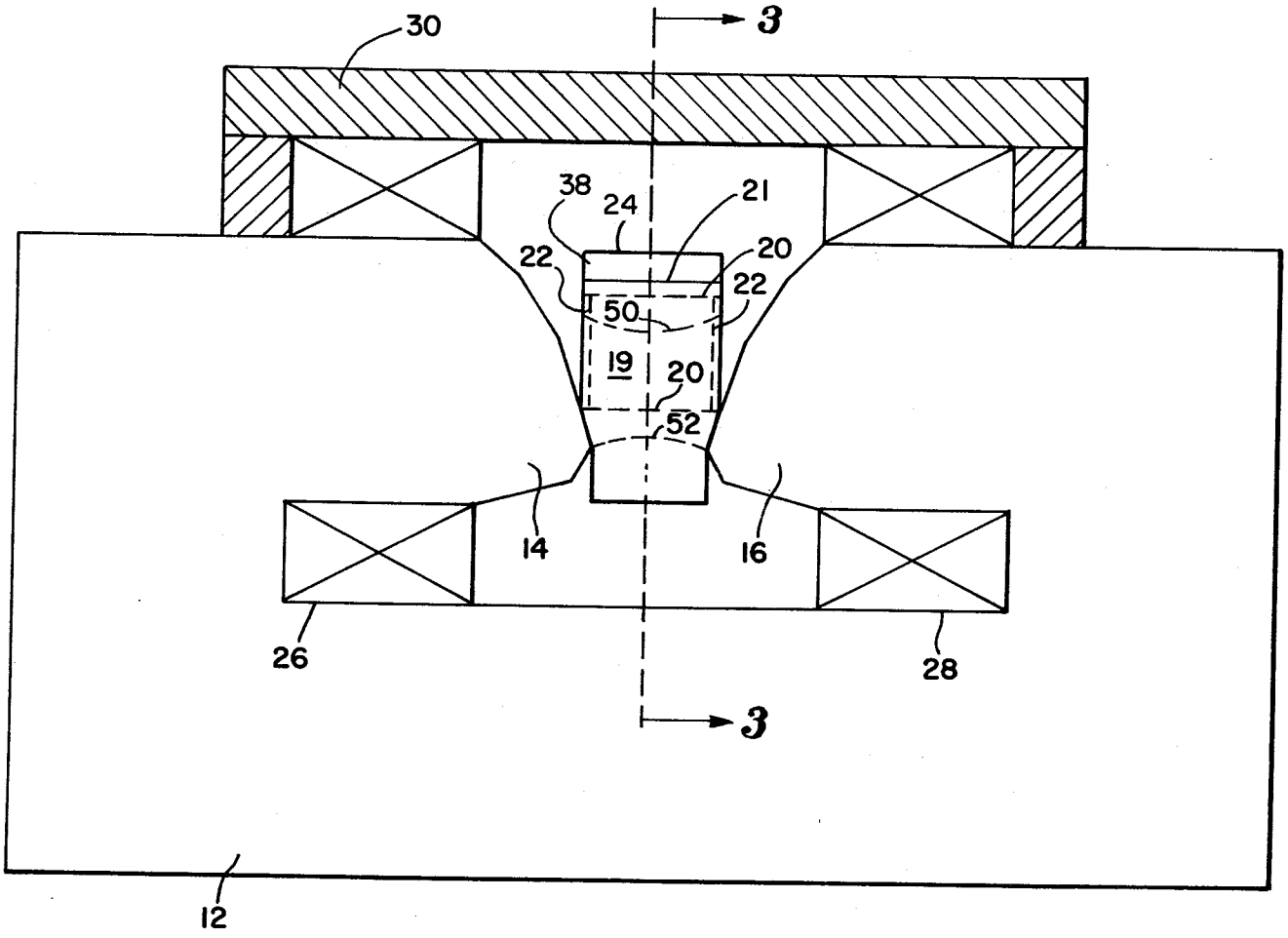
FIG. 2 is a schematic sectional representation of the FIG. 1 showing the ferrofluid levels with respect to the constant gradient volume 19.

FIG. 2 is a sectional representation taken along lines 2—2 in FIG. 1 and includes some additional detail. The magnet 12 including its pole pieces 14 and 16 are shown. A pair of energizing coils 26 and 28 are positioned near the pole pieces 14 and 16 as is conventional. A magnetic plate 30 acts as a magnetic shunt.

The constant gradient volume is again defined by lines 20 and 22. It is also clear that the materials handling apparatus 24 encompasses the constant gradient volume 19. A lower passage 32 near the bottom of the materials handling apparatus 24 is depicted.

Figure 3:
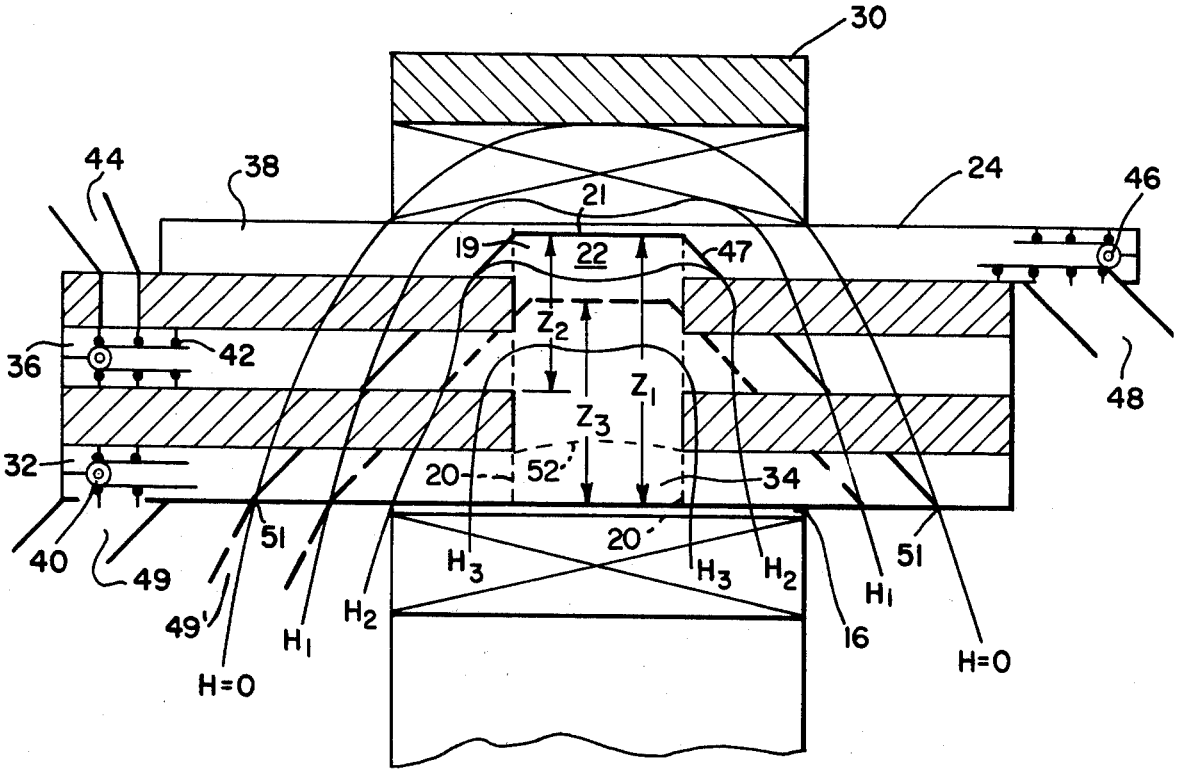
FIG. 3 is a sectional schematic representation taken along lines 3—3 of FIG. 2.

Before discussing the problems and the theory of operation associated with this invention, reference to FIG. 3 is made where the materials handling apparatus 24 is shown in detail. The materials handling apparatus 24 includes a container portion 34 which is intended to be positioned in between the pole pieces 14 and 16 so that the container 34 will encompass the constant gradient volume 19. The materials handling apparatus 24 also includes three vertically spaced passages 32, 36 and 38. It is seen that these passages extend laterally relative to the pole pieces 16 of the magnet 12. The lower passage 32 contains a conveyer 40 for continuously removing material that "sinks" through the ferrofluid column to the bottom of the materials handling apparatus 24.

The middle passage 36 also includes a conveyer 42 and its opening 44 through which feed stock is supplied to the materials handling apparatus 24 and carried into the container 34. Similarly, the passage 38, together with the conveyer 46 and the opening 48 are provided to remove material that "floats" to the top of the ferrofluid column. The specific method of supplying feed material and removing "floats" and "sinks" is provided for illustrative information purposes. Any alternate system, such as dropping the feed through the top of apparatus 24 directly into the ferrofluid, may be used.

To understand the problem encountered, attention is directed to FIG. 2. For a given fluid and a given energizing current, the magnetic field will normally support an unconstrained column of ferrofluid bounded by the dotted lines 50 and 52. Any attempt to add ferrofluid to the column will cause an equal amount to fall out of the bottom of the column as the magnetic field cannot support more ferrofluid. It is not possible to fill the volume 19 with ferrofluid.

Assume for the moment that the container 34 is closed except at the top. Clearly, the container can now be filled with ferrofluid to the level depicted by line 21. The volume 19 can thereby be filled.

So long as the sides and bottom of container 34 have no openings, the ferrofluid remains at level 21. Suppose, however, an opening 32, to remove sinks, is defined in the container 34. The ferrofluid is now free to run out of the container until the column resumes its unconstrained dimensions defined by dotted lines 50 and 52.

Two problems arise. Firstly, the volume 19 is not filled with ferrofluid. The separating capacity provided by the magnet is underutilized with serious economic penalties.

The second problem relates to the size of feed stock that may be processed. For example, if the height of the unconstrained ferrofluid column is four inches and the size of feed stock is about 2 inches, along its largest dimension, there will occur interference between sinks and floats, so perfect or near perfect separation cannot be achieved.

The solution to both of these problems arises if the column of ferrofluid can be raised to the level represented by line 21.

The manner of effecting this solution is best illustrated in FIG. 3.

The materials handling apparatus 24 is shown in section. It includes the container 34 which is positioned in the center of the magnetic field, represented by the pole piece 16.

There are also included a plurality, in this case three essentially horizontal passages 32, 36 and 38. The lower passage 32 is for the removal of sinks. The center passage 36 and aperture 44 provide access for feed stock to the separator. The passage 38 is to remove floats. Conveyors 40, 42, and 46 are symbolic of one illustrative means for continuously supplying or supplying material to and from the column of ferrofluid.

It has been determined that the height of a column of ferrofluid that may be supported by a magnetic field is governed by the following equation:

$$\frac{1}{\rho g}\int_{H_{Z(lower)}}^{H_{Z(upper)}} M\,dH \qquad (1)$$

Where:

| | |
|---|---|
| $H_{Z(lower)}$ | = the magnetic field intensity at the lower boundary of the ferrofluid interface, |
| $H_{Z(upper)}$ | = the magnetic field intensity at the top surface of the ferrofluid, |
| $M$ | = the ferrofluid magnetization, |
| $H$ | = the magnetic field intensity within the ferrofluid, |
| $\rho$ | = the density of ferrofluid, and |
| $g$ | = acceleration of gravity. |

It follows that for a fixed $H_{Z(upper)}$ the maximum height that can be supported occurs when $H_{Z(lower)}$ goes to zero.

Clearly $H_{Z(lower)}$ is always larger than zero in the vicinity of the poles of the magnet. There is, however, a leakage or fringe field which extends outwardly and laterally from the pole pieces, along the axis 45 in FIG. 1. The magnetic field intensity decreases with the distance from the center of the pole pieces. The fringe field eventually goes to zero at infinity. As a practical matter, it is sufficiently close to zero at a small finite distance from the magnet.

In FIG. 3, the curved vertical lines with the H designation depict the fringe field distribution.

The heavy line 47 is representative of the exterior surface of the column of ferrofluid contained within the materials handling apparatus 24 which includes the container 34 and the passages 32, 36 and 38. The line further is representative of the ferrofluid-air interface boundary.

The length of passage 32 is selected to be long enough so that the ferrofluid-air interface at H = 0 occurs within this passage. In practice where possible, the bottom passage location is fixed to coincide with the lower boundary of the constant gradient region 19 so its location is fixed. The ferrofluid column in the constant gradient region may extend from the bottom, or lower marginal edge, of the lower passage to the top of the constant gradient volume. In order for this to be possible, the lower passage must be long enough to allow the ferrofluid-air interface to intersect the H = 0 line within this passage.

Likewise for the other passages, because the ferrofluid-air interfaces occur at larger values of H, e.g. $H_1$ and $H_2$, these passages can be shorter. See FIG. 3.

Given M and $H_{Z(lower)} = 0$, the passage will support a column of ferrofluid having a height $Z_1$, as shown per equation 1.

Passage 36 will support a column having a height $Z_2$ etc.

If, for example, exit port 49 were moved to position 49', the system could not support a ferrofluid column height greater than $Z_3$.

The key, therefore, is to locate the passages or openings into the container 34 so that the lower boundary of said passsage or opening intercepts the magnetic field line which will support the column of ferrofluid previously selected.

The FIG. 3 arrangement permits access and egress from the column of ferrofluid without the need of seals of any sort as ferrofluid does not have a tendency to run out through the various passages.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims:

I claim:

1. A ferrofluid sink/float separator with access means into and out of the ferrofluid comprising:

a. means for supplying a magnetic field capable of supporting an unconstrained column of ferrofluid within the magnetic field, said magnetic field further having defined therein a predetermined volume of space, the top of said volume is positioned in the magnetic field above where the top of the unconstrained column would occur, and b. a partially closed container defined by a bottom closure and side walls containing ferrofluid filling said predetermined volume of space and further containing ferrofluid-air interfaces, the location of which are defined by the relationship:

$$Z = \frac{1}{\rho g}\int_{H_{z(lower)}}^{H_{z(upper)}} M\,dH$$

where:

$H_{z(lower)}$ = the magnetic field intensity at the

-continued

| | |
|---|---|
| | lower edge of the ferrofluid-air interface, |
| $H_{z(upper)}$ | = the magnetic field intensity at the top surface of the ferrofluid |
| $M$ | = the ferrofluid magnetization, |
| $dH$ | = the incremental change of the magnetic field intensity within the ferrofluid, |
| $\rho$ | = the density of the ferrofluid, |
| $g$ | = acceleration of gravity, and |
| $Z$ | = the vertical distance of any point on the interface below the top surface of the ferrofluid. |

c. an access opening in a side wall to expose an interface, the marginal edge of the access opening being no closer to the column of ferrofluid than intercepting the interface.

2. A ferrofluid separator means as provided in claim 1 where a fringe portion of the magnetic field extends out, laterally, from between a pair of pole pieces and said interface is positioned in said fringe portion.

3. a ferrofluid separator means as provided in claim 1 where said predetermined volume is a volume wherein the gradient of the magnetic field intensity is constant.

4. a ferrofluid separator means as provided in claim 1 where said lower edge of the lowermost interface is at or near H = O.

5. A ferrofluid sink/float separator with access means into and out of the ferrofluid comprising:

a. means for supplying a magnetic field capable of supporting an unconstrained column of ferrofluid within the magnetic field, said magnetic field further having defined therein a predetermined volume of space, the top of said volume is positioned in the magnetic field above where the top of the unconstrained column would occur, and b. partially closed container defined by a bottom closure and side walls containing ferrofluid filling said predetermined volume of space, and containing ferrofluid-air interfaces; the location of said interfaces being defined by the relationship:

$$Z = \frac{1}{\rho g} \int_{H_{z(lower)}}^{H_{z(upper)}} M dH$$

where:

| | |
|---|---|
| $H_{z(lower)}$ | = the magnetic field intensity at the lower edge of the ferrofluid-air interface, |
| $H_{z(upper)}$ | = the magnetic field intensity at the top surface of the ferrofluid |
| $M$ | = the ferrofluid magnetization, |
| $dH$ | = the incremental change of the magnetic field intensity within the ferrofluid, |
| $\rho$ | = the density of the ferrofluid, |
| $g$ | = acceleration of gravity, and |
| $Z$ | = the vertical distance of any point on the interface below the top surface of the ferrofluid. |

c. a lower access opening in the side walls for removing sinks and a middle opening for feeding stock to the separator, the respective marginal edges of said openings being no closer to the column of ferrofluid than intercepting an interface.

6. A materials handling apparatus as defined in claim 5 wherein the magnetic field includes a volume wherein the gradient of magnetic field intensity is constant and said ferrofluid fills said volume.

7. A a ferrofluid separator as defined in claim 5 wherein said magnetic field includes a laterally extending fringe portion and said openings are defined in the fringe portion.

* * * * *

UNITED STATES PATENT AND TRADEMARK OFFICE

CERTIFICATE OF CORRECTION

PATENT NO. : 4,052,297

DATED : October 4, 1977

INVENTOR(S) : Leon Mir

It is certified that error appears in the above-identified patent and that said Letters Patent are hereby corrected as shown below:

Column 3, Equation 1, please insert --- $\int$ --- between $\frac{1}{pg}$ and $H_{Z(upper)}$ MdH $H_{Z(lower)}$ Column 4, Equation 2, please insert --- $\int$ --- between $Z = \frac{1}{pg}$ and $H_{z(upper)}$ MdH $H_{z(lower)}$ Column 6, Equation 3, please insert --- $\int$ --- between $Z = \frac{1}{pg}$ and $H_{z(upper)}$ MdH $H_{z(lower)}$ Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*